United States Patent [19]

Barnett

[11] Patent Number: 4,851,822

[45] Date of Patent: Jul. 25, 1989

[54] ELECTRONIC MONITORING SYSTEM

[75] Inventor: James S. Barnett, Lakewood, Wash.

[73] Assignee: Frank P. Moss, Jr., Bradenton, Fla.

[21] Appl. No.: 945,225

[22] Filed: Dec. 24, 1986

Related U.S. Application Data

[63] Continuation of Ser. No. 823,136, Jan. 27, 1986, abandoned, which is a continuation of Ser. No. 534,216, Sep. 20, 1983, abandoned.

[51] Int. Cl.[4] ..... G08B 21/00

[52] U.S. Cl. ..... 340/635; 340/585

[58] Field of Search ..... 340/635, 584, 585, 525, 340/63; 364/479

[56] References Cited

U.S. PATENT DOCUMENTS 4,024,495 5/1977 O'Brien ..... 340/585 X
4,053,868 10/1977 Cox et al. ..... 340/525 X
4,134,101 1/1979 Jones, Jr. ..... 340/52 D
4,240,077 12/1980 Hughes et al. ..... 340/584
4,412,292 10/1983 Sedam et al. ..... 364/479

FOREIGN PATENT DOCUMENTS 2031631 4/1980 United Kingdom ..... 340/585

OTHER PUBLICATIONS

"Freezer Alarm", R. Mackay, p. V, Practical Electronics, Jul. 1981 vol. 17 No. 7.

*Primary Examiner*—Joseph A. Orsino
*Assistant Examiner*—Jeffery A. Hofsass

[57] ABSTRACT

An electronic monitoring system for a refrigerated unit has sensing means responsive to temperature within the unit, conditions of the engine driving a compressor, security controls of the unit, all interconnected with solid state programming means in order to provide visual, audio, and transponding alarms in the event of a malfunction within the unit.

6 Claims, 4 Drawing Sheets

ELECTRONIC MONITORING SYSTEM

This is a continuation of co-pending application Ser. No. 823,136 filed on Jan. 27, 1986, now abandoned, which was a continuation of Ser. No. 534,216 filed on Sept. 20, 1983, now abandoned.

FIELD OF THE INVENTION

My invention relates to a monitoring system, and more particularly, to a monitoring system for a unit which unit has certain conditions which need to be observed and controlled.

Still more particularly, my invention relates to a monitoring system for an area or compartment which has certain conditions which require attention, and includes an alarm system to bring an undesirable condition within the area or compartment to the attention of someone in control of the monitoring system.

Still more particularly, my invention relates to a monitoring system adaptable to survey physical conditions, such as temperature, and security conditions, such as intrusions or inoperativeness, of a compartment, such as a refrigerated trailer, and relay present status conditions to an alarm system when any condition being observed, reaches an undesirable status.

BACKGROUND OF THE INVENTION

Many monitoring systems have been designed for observing and controlling a specific condition within an area or compartment and creating an alarm signal when there is a malfunction within the system. For example, many systems have been designed to monitor and control the temperature of a refrigerated area or compartment, such as a refrigerated room within a supermarket, or a refrigerated trailer as it is being towed by a truck. Such systems are necessary to protect a high investment in food products, or manufacturing processes, or even animals. Specifically, a refrigerated trailer might be transporting food products at temperatures below freezing. A trailer might be transporting chemicals at extremely low temperatures. A chemical process plant be refrigerating, or heating, a chemical process within certain controllable limits. Or, a trailer might be transporting live animals under temperature conditions which need to be comfortable and healthful.

Some of the typical monitoring systems found in the prior art are described in the following U.S. Pat. Nos. :

2,753,692, Dickieson, Jr., July 10, 1956
2,994,858, Coffer, Aug. 1, 1961
3,100,383, Foster et al, Aug. 13, 1963
3,441,929, Coffer et al, April 29, 1969
3,954,752, Atton, July 20, 1971
4,024,495, O'Brien, May 17, 1977
4,146,085, Wills, Mar. 27, 1979
4,187,093, Boratgis et al, Feb. 5, 1980
4,283,921, Prosky, Aug. 18, 1981
4,307,775, Saunders et al, Dec. 29, 1981
4,313,308, Boratgis et al, Feb. 2, 1982
4,325,223, Cantley, Apr. 20, 1982

Therefore, the primary object of my invention is to provide a monitoring system for a unit which is efficient, easy to operate, and inexpensive.

Another object of my invention is to provide a monitoring system for a unit or area which is adaptable to observe a condition of that unit or area and respond to control means for that condition.

Still another object of my invention is to provide a monitoring system for a unit or area which is adaptable to observe a condition of that unit or area and provide a malfunction signal if that condition reaches an undesirable status.

Still another object of my invention is to provide a monitoring system for a unit or area which system is adaptable to observe a condition of that unit or area and transpond a signal to a remote receiver.

A still further object of my invention is to provide a monitoring system which will respond to a physical state of a compartment and provide an alarm signal if the physical state should be undesirable.

SUMMARY OF THE INVENTION

In summary, I have designed a monitoring system for a unit or area for use where substantial investment in equipment and goods has been made necessary and even much greater financial factors depend upon the continual monitoring, control, and immediate correction of all parametric conditions associated with that unit or area.

For example, in one limited field where my monitoring system is extremely valuable is in the transportation of refrigerated products by truck and trailer. If a refrigerated system should malfunction, a valuable cargo could be lost before the driver would be aware of any danger. It is even conceivable that he might not be capable of protecting the cargo even if he were aware of a malfunction. With my system, I have provided means to transmit the status of all the important conditions of the unit to a chosen location, which may be to the cab of the truck, to portable equipment carried by the driver while he is out of the truck, or to a remote control center. I have planned my system to provide for closer monitoring of many conditions in order to eliminate loss of cargo and, consequently, to provide for lower insurance rates by reason of fewer claims for lost cargo.

I have provided for both visual alarm components and audio alarm components. I have felt a need for the combination of these two forms of alerts because the driver of large equipment cannot devote much time to the reading of small gauges, particularly small gauges which might be out of his line of vision while he is driving at high speed. Furthermore, if he is aware of a sudden malfunction, he cannot devote time to the adjustment of dials while driving, or cannot continually stop to adjust dials.

I have referred to a malfunction of a condition in a refrigerated trailer for one use of my invention. A malfunction in a refrigerated trailer might be caused by a ruptured line in one of the components of the engine providing cooling for the trailer compartment, as by a ruptured oil line, water line, fuel line, or refrigerant line; or by a broken seal within one of those components; or even a low fluid in one of them caused by improper maintenance.

Again, as I wish to emphasize, I have referred to my monitoring system in relation to a heavy-duty truck-trailer combination, but I am stressing that the system could be adaptable to the other units or areas I indicated.

I have stated that in the current monitoring systems available today, the main concern is for the monitoring of a total refrigerating system, not specific components of that system. I am monitoring various components of the general system.

Also, I have provided for my monitoring displays, that is, the dials which indicate the status of the various conditions, to be digital read-out displays, so that the operator, as a driver of a semi-trailer truck, may see at a quick glance, the status of each condition. Besides this benefit, digital displays are extremely dependable, quick to repair or replace, and very inexpensive.

I have provided for all the switches and alarm controls to be illuminated so that the driver may quickly locate and touch any one or more which must be adjusted.

I have designed my system so that it may easily and quickly be installed in a truck cab, trailer body, or similar unit by the use of simplified panels, mounting brackets, and quick-connect plugs and cables.

I believe that a very important consideration today, and increasingly so in the future, in association with the transportation of goods will be the need to have extremely accurate knowledge of the status of those goods, both from the consideration of the physical condition of the goods and the economical movement of those goods. I have provided means for transmitting to a designated receiving station the actual physical condition of the goods by my system of controls and alarms, and I have provided means for transmitting to the receiving station what I have referred to as the economical movement of the goods, by means of coded signals noting actual time in movement. Thus, better accounting practices can be achieved in movement of goods. Also, I anticipate that much greater security can be achieved with that type of control.

All these and other objects of my invention will become apparent from the accompanying drawings and description and claims which describe my invention as an electronic monitoring system for a unit comprising a sensor circuit adaptable for sensing a condition of the unit and creating a first electrical signal, reference means adaptable to provide a second electrical signal at a chosen reference point, comparator means adaptable to receive the first electrical signal and the second electrical signal and compare the first electrical signal with the second electrical signal and emit a controlling signal, control means including an automatic control element to adjust the condition in accordance with the controlling signal and manual adjustment means to adjust the reference means at a chosen point, alarm means adaptable to react in reference to the controlling signal, and transporting means adaptable to transmit a signal from the alarm means.

DESCRIPTION OF THE PREFERRED EMBODIMENTS

Figure 1A:
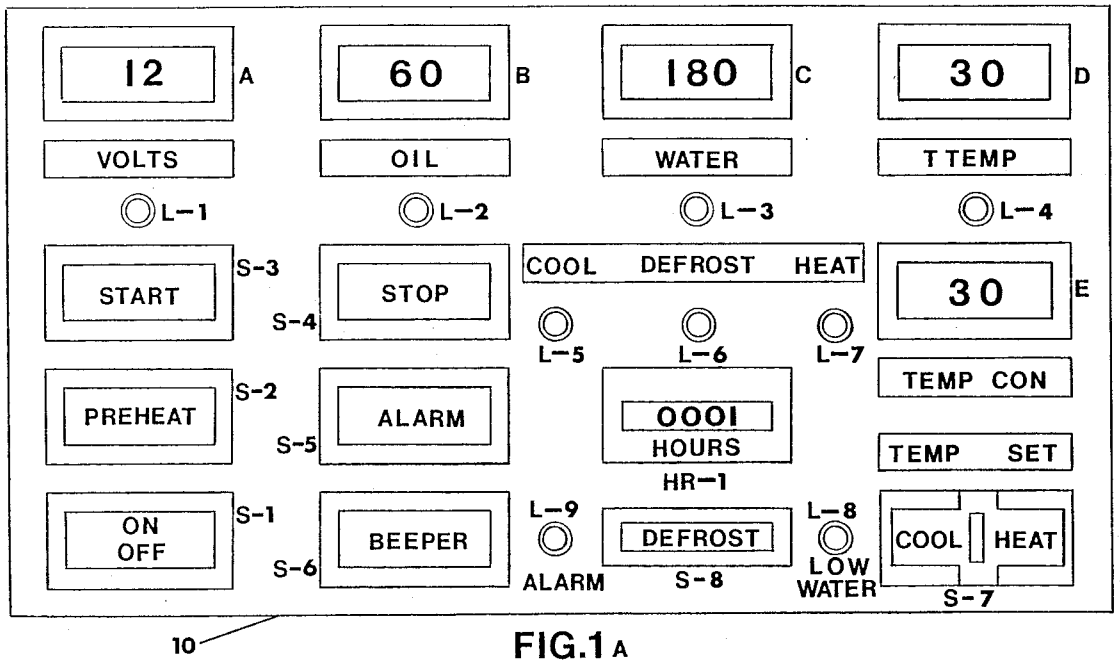
FIG. 1*a* is a front elevational view of a panel showing the digital displays of conditions being monitored and showing arrangement of control switches.
Figure 1:
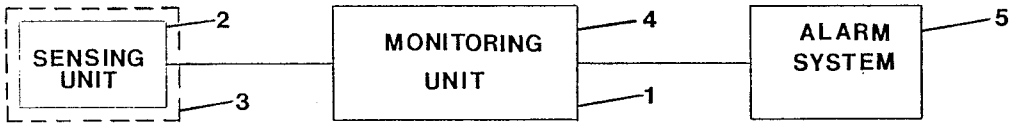
FIG. 1 is a block diagram outlining the general system of my invention.

In FIG. 1 I have shown in block diagram form, in a most general way, an electronic monitoring system 1, according to my invention, describing the basic components, as a sensing unit 2, within a unit or area 3, and with sensing unit 2 being connected cooperatively with a monitoring unit 4, which provides the essential control and reference means for the sensing of a condition within unit 3, and consequently with monitoring unit 4 connected cooperatively with an alarm system 5, designed to dispense the chosen type of alarm signal.

In FIG. 1*a* I have described a typical display and control panel 10, generally, according to my invention as one should be prepared and assembled in the cab of a semi-trailer truck within easy view of the driver. As I mentioned above, I have designed digital read-out display components A, B, C, D, E, and HR-1 to show the status of the various conditions of the system because digital displays are much more easily and quickly read than are gauges. Components A, B, C, D, E, and HR-1 display respectively: "Volts", as the condition of the battery of the refrigerating system; "Oil", as the current oil pressure of the engine: "Water", as the current temperature of the cooling system of the engine; "T Temp" as the inside temperature of the trailer or compartment: "Temp Con", as the temperature setting of the thermostat; "Hours", as the actual running time of the refrigeration unit engine, which is an extremely valuable factor and is intended to serve several purposes. The circuitry associated with "Hours" display HR-1 can be used to provide a transmitted signal (to a base receiver) or can be put on conventional magnetic type within the system 10, of the actual running time of the engine so that accurate records may be maintained of that running time both as a measure of security for the refrigerated trailer, or as an indication of any neglectful actions by the operator, or for the sake of scheduling proper maintenance and repair to the engine.

On this panel 10, I have included all the necessary control, display, and alarm means for easy access by the driver of a semi-trailer or operator of a refrigerated system. For example, in association with each of the displays A, B, C, and D, I have provided signal lights which I have labeled L-1, L-2, L03, and L-4, which are conventional LED lights, and serve as warning signals to the operator of a malfunction in that particular component of the system.

On this panel 10, I have further provided a series of LED lights, L-5, L-6, and L-7, which are connected to the circuitry of the refrigeration compressor, and are arranged to indicate to the operator at a glance the current cycle of the compressor by the indication of which light is on. L-5 indicates that the compressor is in a cooling stage, L-6 indicates that the compressor is in a defrosting cycle, and L-7 indicates that the compressor is in a heating cycle. Preferably, the lenses of these lights should be colored to further indicate quickly the present cycle, but should the operator be color-blind, he may still ascertain by the position of the light which is actuated, the present cycle.

I have provided by LED lights L-8 and L-9 a further pair of alarm lights, wherein L-8 indicates a condition of low water in the engine of the refrigerating unit, and L-9 is a central alarm light and acts as a visual indicator of a malfunction in one of the systems being monitored. This acts as a quick reference for all the alarms in the system.

I have provided on this panel a series of switches for control of the system. I shall describe here the operation of each switch, and I show in the drawings the circuitry associated with each switch, with the circuitry being readily understood by one skilled in the art.

An "on-off" switch, S-1, is a double-action switch to turn the monitoring system on or off. A pre-heating switch S-2 is provided to supply 12 vdc from the engine battery to a solenoid within the engine to deliver current to a series of glow plugs, in the case of a diesel engine, to heat the fuel. The switch is held down until the engine starts.

A starter switch S-3 is a momentary switch connected to the starter solenoid of the engine. This switch is actuated at the proper time, and then, when the engine starts, both switch S-2 and S-3 are released.

I have provided a stop switch S-4 which is connected directly to the engine, preferably to a solenoid mounted on a governor or like control within the engine, in a manner that the operator may have a quick means of stopping the engine of the refrigerating unit should one or mor eof the control systems within the system fail, or if a shut-down component within the system should fail to operate properly after a malfunction within the system.

An alarm switch S-5 is a double-action switch which provides means for the control circuitry of the system to be connected to a central alarm circuit. Of course, it can be readily understood that this switch should be activated only when the operator has assured himself that the conditions of the entire system have reached the proper state of control. For example, he should wait until the oil pressure has built up sufficiently, or an alarm would result. Or, he should be satisified that the temperature of the unit is within the range already chosen by the controls, or else an alarm would result.

I have provided a beeper switch S-6 which is a double-action switch, as shown in the circuitry, combined with the program so that in the event a system should malfunction while the operator is away from the unit, the alarm system will transmit a coded message to portable receiving apparatus carried by the operator to let him know there is a problem and will identify the component which has failed. This switch is also a part of the circuitry for a key-operated security switch K-S on the truck, on the trailer, or on both, and also for a transponder described in further drawings, so that at the time a message is transmitted to a central receiving station if an entry is attempted while the operator is away from the unit.

After these adjustments, the operator may adjust a thermostat control switch S-10 to provide a suitable setting of the refrigeration system thermostat. This switch is a spring-loaded toggle switch which is normally in the center position. The operator depresses the side of the switch marked "Cool" to adjust the thermostat to a lower temperature, and depresses the side marked "Heat" to adjust the thermostat to a higher setting. The activation of this switch operates a 2 rpm reversible motor as described in FIG. 2. Also, the digital read-out on the panel will show the thermostat setting.

Figure 2:
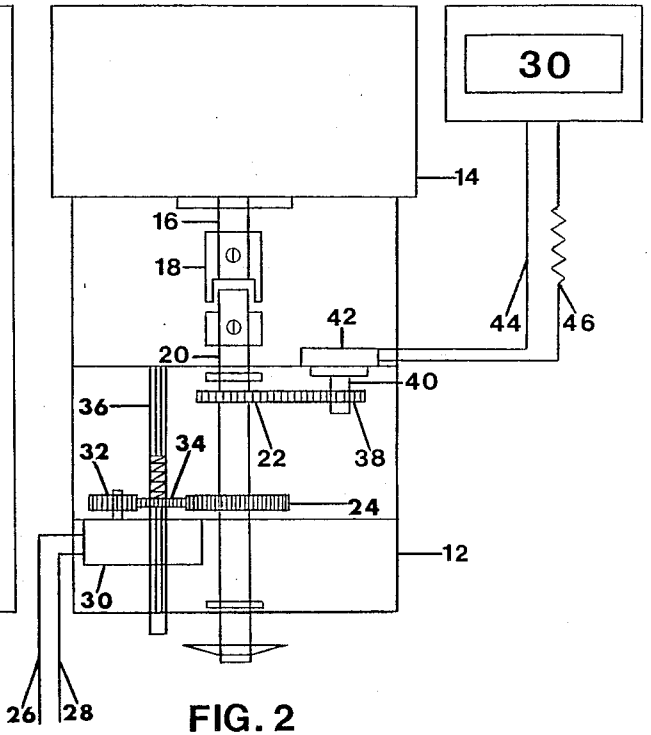
FIG. 2 is a top view of a controlling mechanism for a thermostat component of my invention.

In FIG. 2, I describe a remote thermostat control unit 12, generally, for my system. The unit 12 is adaptable to be mounted in the wall of a refrigerated compartment in a manner that a thermostat 14 which includes a conventional thermal probe (not shown in this drawing), exposed to the atmosphere of the compartment, and a conventional controlling device, such as a bi-metallic control, attached to shaft 16 coupled by a coupler 18 to another shaft 20 upon which is mounted a pair of gears 22 and 24. The thermostat unit 12 is adaptable to be adjusted either electrically and remotely, as from the truck cab, or manually at the unit itself. This is shown by wire leads 26 and 28 connected through the circuitry of the system to the control switch S-7. Then, wires 26 and 28 carry power to a 12 vdc 2 rpm reversible motor 30. Motor 30 drives a gear 32 which is interconnected through gear 34 on shaft 36 with gear 24. Movement of shaft 20 also directs the movement of gear 22 in cooperation with gear 38 on a shaft 40 to drive a linear potentiometer 42. Potentiometer 42 is connected through wires 44 and 46 to the digital display E.

Figure 3:
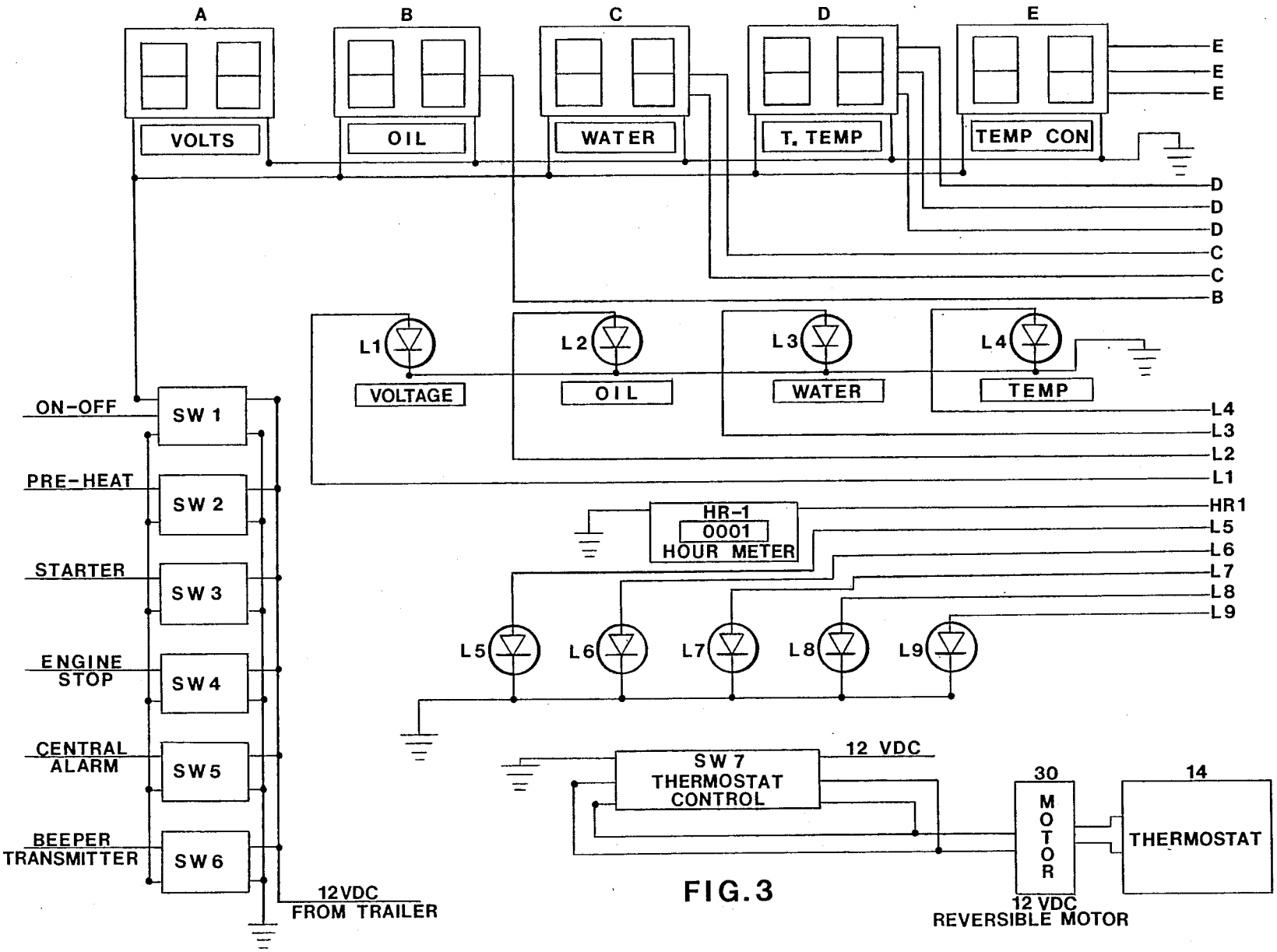
FIG. 3 is a schematic diagram of the circuitry, displays, and control switches of a portion of the monitoring system of my invention.
Figure 4:
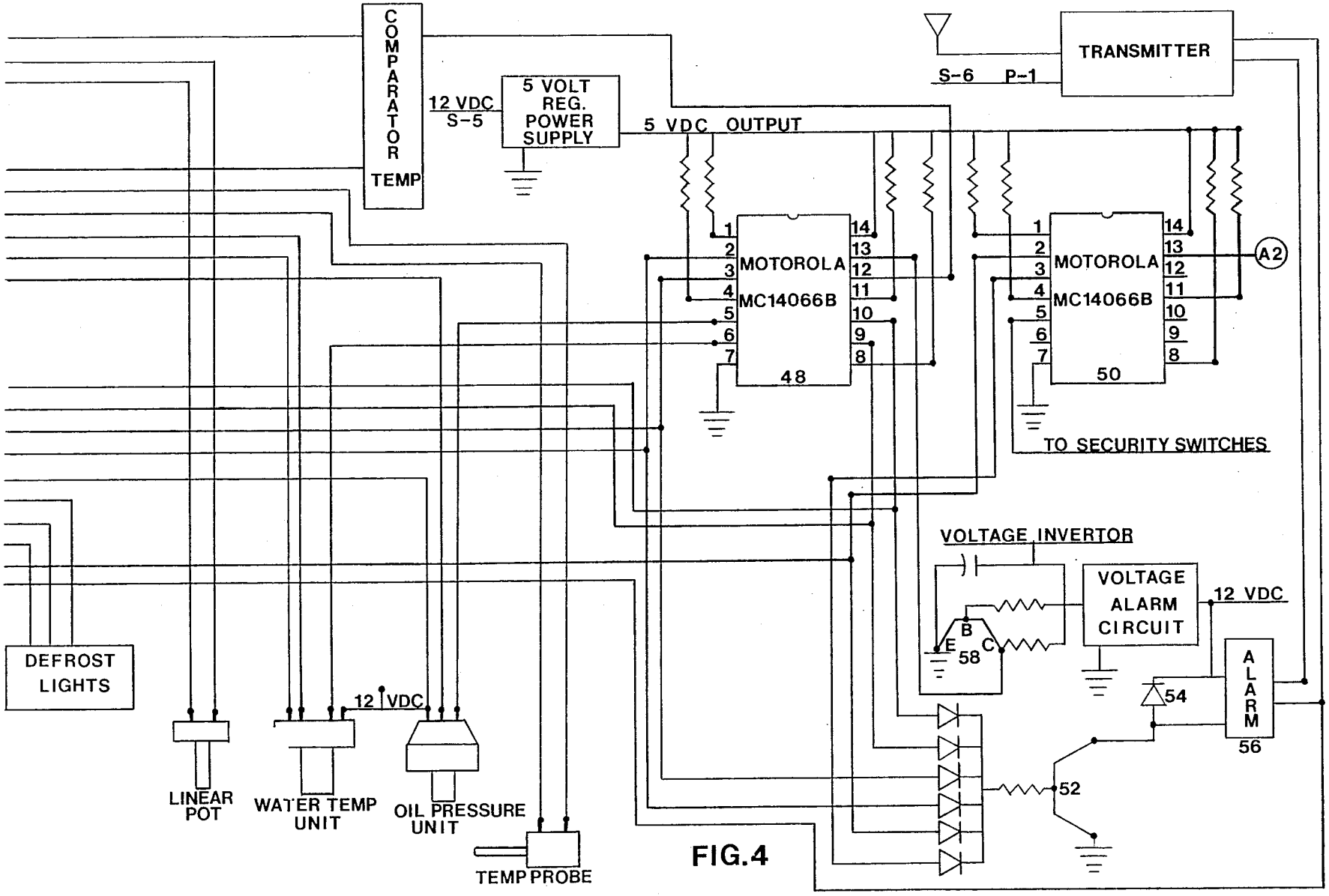
FIG. 4 is a schematic diagram of the circuitry, controls, sensing and comparing components, and alarm components of a portion of the monitoring system according to my invention, and indicating the relationship of FIG. 4 to FIG. 3 and the connection of components thereto.

FIGS. 3 and 4, as I have shown, are related, and taken together, as I have shown by the graphic designations on the right side of FIG. 3 and left side of FIG. 4, from the main circuitry of my invention. The circuitry and functions of the solid state components within that circuit are conventional and are readily understood by one skilled in the art.

In the circuitry of FIGS. 3 and 4 I have shown a conventional 5 vdc regulated power supply receiving power from the 12 vdc battery and electrical system of the engine and converting that voltage to the 5 vdc required by the solid state components.

The regulated 5 vdc power supply supplies 5 vdc to solid state chips 48 and 50, which are shown as Motorola chips MC-14066B. The resistors in line with pins 1, 4, 8, and 11 of each chip are current limiting resistors, used to reduce the current through the MC-14066B integrated chips. This current passes from pin 1 to pin 2 of each chip when a signal to a switch closing pin 13 of either chip has reached logic 1 voltage in response to a signal from a sensor associated therewith.

Signal strength from the sensors is limited to 5 vdc for the digital logic as is well-known.

The current passing through pin 2 of chip 48 splits at the node connecting the LED indicator L-1 with the chip, giving L-1 its operating voltage. At the same time, current passes from pin 2 to a diode of diode assembly 1 giving that diode operating forward voltage, turning on transistor TIP-122, 52, connected to a current directing diode 54 in circuit with an alarm network 56, which may be a horn and an opto-coupler network.

When operating voltage is available to alarm network 56, as one example, a horn or similar signal device is activated, a conventional opto-coupler functions, and the transmitter is turned on. For the sake of brevity, as is easily understood, this is the same operation for the other alarm and sensing circuits. As I have shown in this FIG., chip 50 has its pin 13 connected to a low water sensor A-2.

In chip 48, voltage across pins 1 and 2 is controlled by a signal from pin 13. Voltage across pins 3 and 4 is controlled by a signal from pin 5. Voltage across pins 8 and 9 is controlled by a signal from pin 6. Voltage across pins 10 and 11 is controlled by a signal from pin 12. Pin 7 is connected to ground, and pin 14 supplies a regulated 5 vdc.

A signal from the voltage alarm circuit supplies voltage to a resistor in line with the base of a transistor FPN 364, 58, which switches the transistor into conduction allowing a signal to pass from the collector of this transistor through a voltage inverter network to pin 13 of chip 48.

Figure 5:
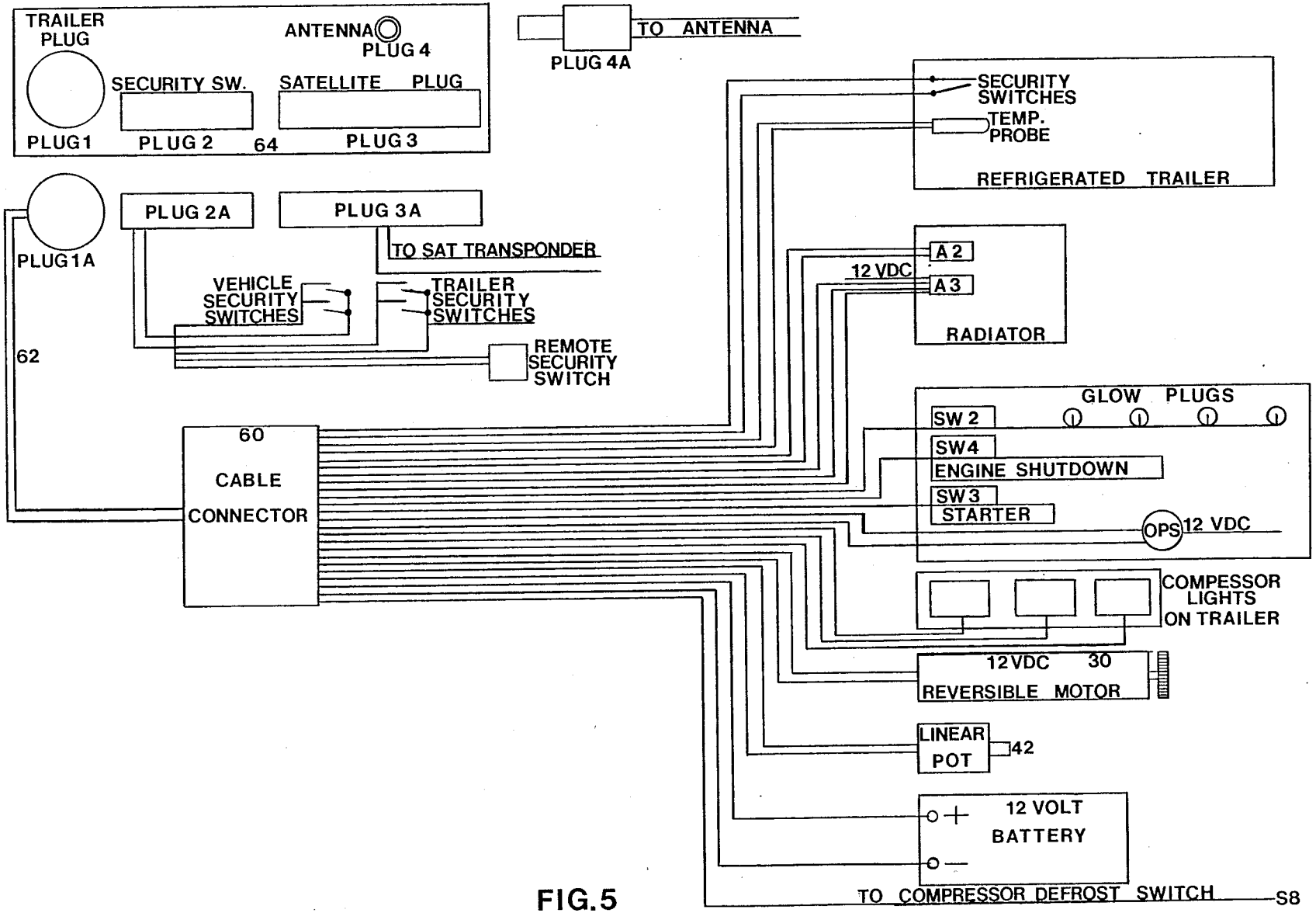
FIG. 5 is a schematic diagram of the circuitry and controlling components of a portion of my invention.

In FIG. 5 I have shown schematically and diagrammatically another portion of the circuitry of my invention. I have shown by a series of block diagrams, for simplicity, that the wire leads of many components lead to a cable connector 60 converging schematically into a cable 62 connected with components of plug 1-A which cooperates with plug 1 installed at a convenient point, such as a removable panel 64 installed in the trailer or compartment. Plugs 2 and 2-A are shown to be cooperative, plugs 3 and 3-A are shown to be cooperative, and plugs 4 and 4-A are shown to be cooperative, all in a manner to connect these various portions of the circuitry. As I have indicated, my system is intended to provide transponded signals to a remote receiver, and, for the most successful and efficient control, this is intended to be by transmission to a satellite system. This type of transmission can be easily accomplished by conventional equipment aligned in the manner I have designed and described for my system.

Since many different embodiments of my invention may be made without departing from the spirit and scope thereof, it is to be understood that the specific embodiments described in detail herein are not to be taken in a limiting sense, since the scope of the invention is best defined by the appended claims.

I claim:

1. In a refrigerated trailer which includes a refrigeratable compartment and an engine to drive a refrigerating compressor, an electronic monitoring system comprising:

A sensor circuit having interconnected means for setting:
an on-off condition of the system,
a temperature control device,
an engine pre-heat switch,
an engine stop switch,
a central alarm switch, and
a security switch, the sensor circuit being adapted for sensing a status of a plurality of conditions of the refrigeration system and transmitting conditions of the system to a chosen location, including the conditions of:
security of the refrigerated trailer system,
water temperature of the engine,
water level of the engine,
oil pressure of the engine,
voltage level of a battery of the engine,
temperature of the refrigerated compartment,
refrigeration compressor cycle,
running time of the engine, and
thermostat control setting, the sensor circuit also including interconnected logic circuit means for developing a controlling signal upon detection of an undesirable status within any portion of the sensor circuit, the sensor circuit further adapted to include a thermostat positionable on the refrigerating unit, wherein the thermostat is remotely adjustable in addition to being manually adjustable.

alarm means adapted to react in reference to the controlling signal, and transponding means adapted to transmit a signal from the alarm means.

2. An electronic monitoring system for a refrigerated trailer system as described in claim 1, wherein a central alarm portion of the sensor circuit includes a transmitting circuit adapted to connect the alarm system and security system to a portable receiver.

3. An electronic monitoring system for a refrigeration system as described in claim 2, wherein the sensor circuit is adapted to transmit a singular or plurality of conditions to a remote receiver within or outside a cab of a truck hauling a trailer containing the refrigeratable compartment, the sensor circuit is adapted to transmit the singular or plurality of conditions to a portable receiver, and the sensor circuit is adapted to transmit the singular or plurality of conditions to a central receiving station.

4. An electronic monitoring system for a refrigerated trailer system as described in claim 3, wherein the sensor circuit is adapted to transmit the singular or plurality of conditions to a satellite system by means of a satellite transponder.

5. An electronic monitoring system for a refrigerated trailer system as described in claim 4, which includes a control unit which all the necessary controls, displays and transponder are contained.

6. An electronic monitoring system for a refrigerated trailer system as described in claim 5, wherein the control unit.

provides complete monitoring of the sensor circuits, and transponding of there conditions while being stored or transported.

* * * * *